US006766718B2

(12) United States Patent
Hu

(10) Patent No.: US 6,766,718 B2
(45) **Date of Patent: *Jul. 27, 2004**

(54) WRENCH WITH A FIXED MAXIMUM OPERATIONAL TORQUE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 191 days.

This patent is subject to a terminal disclaimer.

(21) Appl. No.: 10/046,115

(22) Filed: Jan. 7, 2002

(65) Prior Publication Data

US 2003/0205115 A1 Nov. 6, 2003

(30) Foreign Application Priority Data

Oct. 29, 2001 (TW) ..... 90218720 U

(51) Int. Cl.[7] ..... B25B 23/14
(52) U.S. Cl. ..... 81/475; 81/467
(58) Field of Search ..... 81/467, 478, 480, 81/481, 475; 464/35, 37

(56) References Cited

U.S. PATENT DOCUMENTS 2,157,574 A * 5/1939 Siesel ..... 464/35
2,300,652 A * 11/1942 Cooney ..... 81/483
2,332,971 A * 10/1943 Johnson ..... 81/480
2,396,027 A * 3/1946 Spayd ..... 81/480
2,601,044 A * 6/1952 Mayer ..... 81/480
2,768,547 A * 10/1956 Noell ..... 81/480
2,826,107 A * 3/1958 Woods ..... 81/480
2,924,134 A * 2/1960 Harmes ..... 81/467
2,972,271 A * 2/1961 Gill ..... 81/480
3,593,542 A * 7/1971 Urayama ..... 464/37
3,651,718 A * 3/1972 Thomasian ..... 81/480
4,238,978 A * 12/1980 Leone ..... 81/480
4,308,770 A * 1/1982 MacDonald ..... 81/177.2
5,152,200 A * 10/1992 Kaplan ..... 81/467
5,822,830 A * 10/1998 Lin ..... 16/422
6,029,551 A * 2/2000 Wu ..... 81/475
6,076,439 A * 6/2000 Dzieman ..... 81/473
6,155,147 A * 12/2000 Dzieman ..... 81/473
6,439,086 B1 * 8/2002 Bahr ..... 81/467
6,487,943 B1 * 12/2002 Jansson et al. ..... 81/475
6,502,483 B1 * 1/2003 Swank et al. ..... 81/437
2003/0010162 A1 * 1/2003 Hu
2003/0010163 A1 1/2003 Hu
2003/0079577 A1 5/2003 Hu
2003/0079578 A1 5/2003 Hu
2003/0079579 A1 5/2003 Hu
2003/0205114 A1 11/2003 Hu

* cited by examiner

*Primary Examiner*—Lee D. Wilson
(74) *Attorney, Agent, or Firm*—Alan Kamrath

(57) ABSTRACT

A wrench includes a rod, a retainer, and a casing for accommodating the retainer and allowing relative pivotal movement between the casing and the retainer. The rod includes a driving portion on an end thereof for engaging with a fastener. The retainer has a first end securely mounted to the rod to turn therewith and a second end. An engaging member is mounted in the casing and biased to engage with the second end of the retainer, thereby exerting an engaging force between the second end of the retainer and the engaging member. When a rotational force applied to the casing is smaller than the engaging force, the retainer and the rod are turned to thereby turn the fastener. When a rotational force applied to the casing is greater than the engaging force, the casing slides relative to the retainer while the retainer and the rod are not turned.

32 Claims, 15 Drawing Sheets

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to the object secured by a fastener driven by the wrench.

2. Description of the Related Art

FIG. 16A of the drawings illustrates a conventional wrench 1 having a hexagonal driving portion with six planar faces 2 for engaging with six faces of a hexagonal groove in a top face of a fastener. However, slide tends to occur between the planar faces of the driving portion of the wrench 1 and the faces of the fastener. FIG. 16B illustrates a so-called TROX wrench 3 having plural arcuate faces 4 for engaging with corresponding arcuate faces in a top face of a fastener. Such a TROX wrench 3 is used to tighten important parts of a car and cutting tools. As illustrated in FIG. 17, a blade 7 is tightened to a cutting tool 5 by a bolt 6. However, the expensive blade 7 tends to be damaged when the bolt 6 is excessively tightened. But the blade 7 could fly away and thus cause injury if the bolt 6 is not tightened to the desired extent.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener resulting from over-tightening is prevented.

Another object of the present invention is to provide a wrench with a fixed maximum operational torque that can be altered in response to the actual use.

In accordance with one aspect of the present invention, a wrench comprises a rod, a retainer, and a casing for accommodating the retainer and allowing relative pivotal movement between the casing and the retainer. The rod comprises a driving portion on an end thereof for engaging with a fastener. The retainer has a first end securely mounted to the rod to turn therewith and a second end. An engaging member is mounted in the casing and biased to engage with the second end of the retainer, thereby exerting an engaging force between the second end of the retainer and the engaging member. When a rotational force applied to the casing is smaller than the engaging force, the retainer and the rod are turned to thereby turn the fastener. When a rotational force applied to the casing is greater than the engaging force, the casing slides relative to the retainer while the retainer and the rod are not turned.

In accordance with a second aspect of the invention, a wrench comprises a rod, a retainer, and a casing. The rod comprises a driving portion on an end thereof for engaging with a fastener. The retainer has a central portion securely mounted to the rod to turn therewith and two ends. The casing accommodates the retainer and allows relative pivotal movement between the casing and the retainer. Two engaging members are mounted in the casing and biased to respectively engage with the ends of the retainer, thereby exerting an engaging force between each of the ends of the retainer and an associated one of the engaging members. When a rotational force applied to the casing is smaller than the engaging force, the retainer and the rod are turned to thereby turn the fastener. When a rotational force applied to the casing is greater than the engaging force, the casing slides while the retainer and the rod are not turned.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
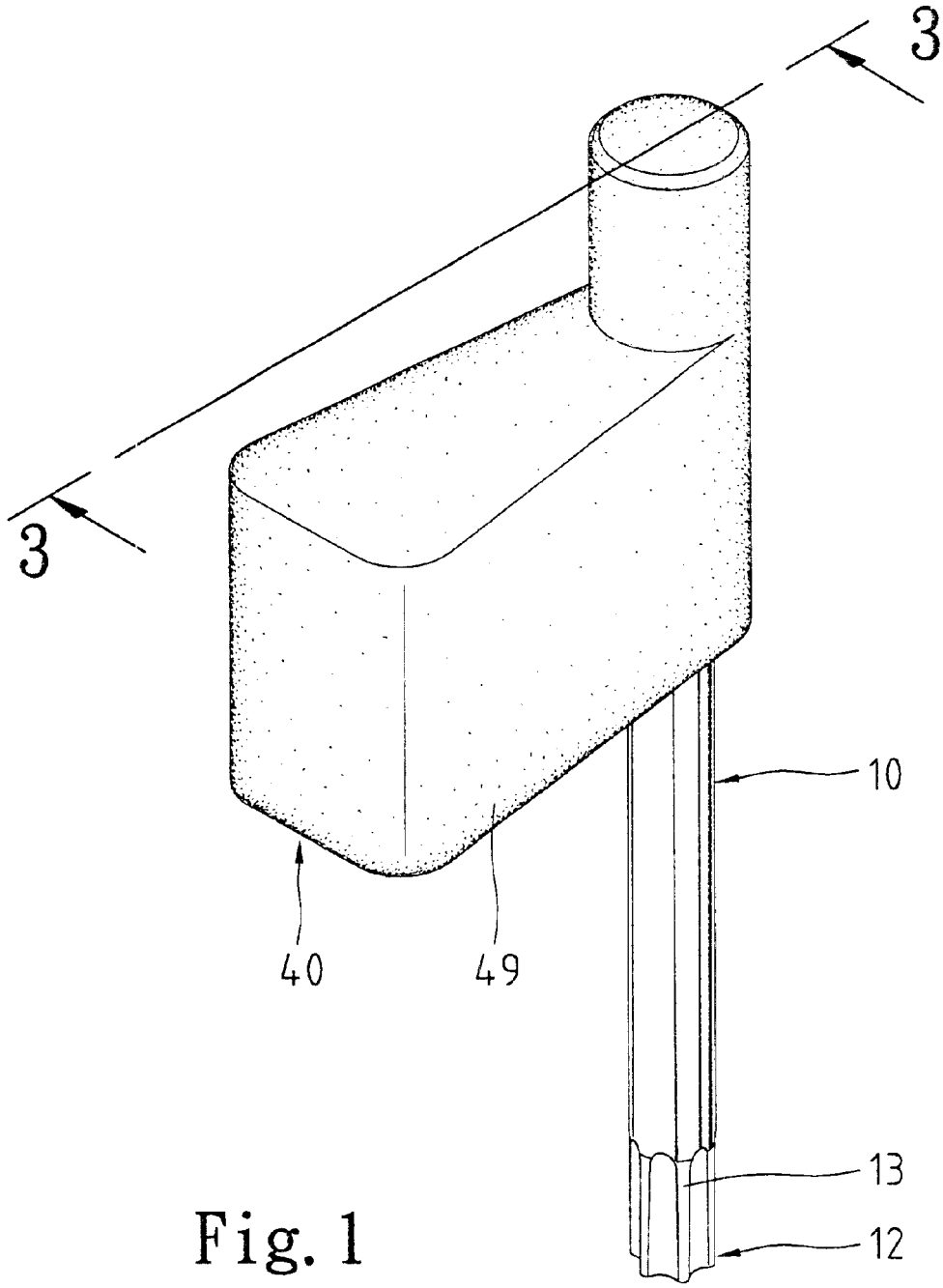
FIG. 1 is a perspective view of a wrench in accordance with the present invention.
Figure 2:
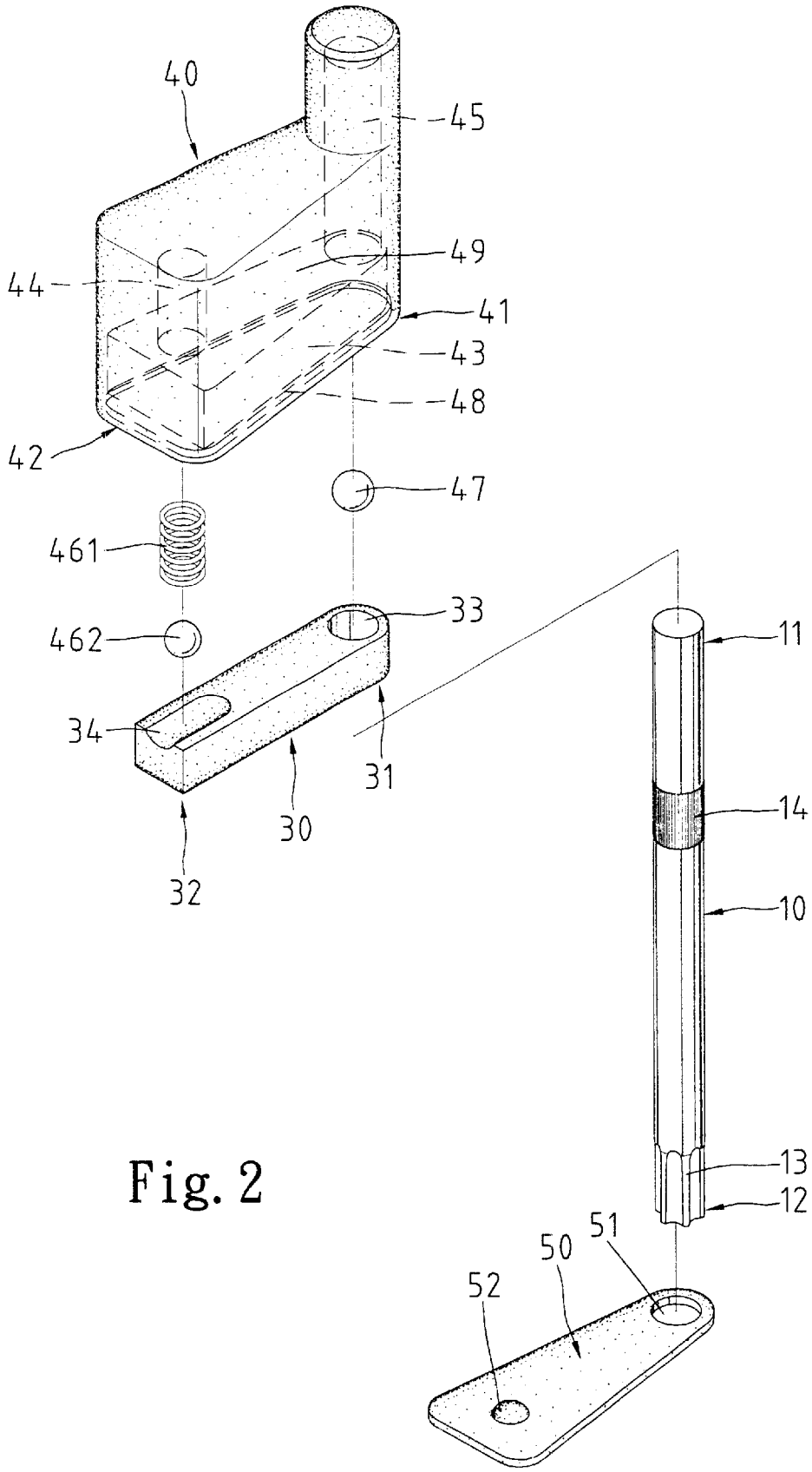
FIG. 2 is an exploded perspective view of the wrench in accordance with the present invention.

Referring to FIGS. 1 and 2, a wrench in accordance with the present invention generally includes a rod 10, a retainer 30, and a casing 40. The rod 10 comprises a first end 11 and a second end 12 with a driving portion 13 for engaging with a fastener. In this embodiment, the driving portion 13 is shaped as a TROX type wrench. The rod 10 further has an embossed section 14 that is preferably adjacent to the first end 11 thereof.

The retainer 30 includes a hole 33 in a first end 31 thereof for securely engaging with the embossed section 14 of the rod 10. Thus, the retainer 30 and the rod 10 rotate jointly. The retainer 30 further includes a groove 34 in a second end 32 thereof.

Figure 3:
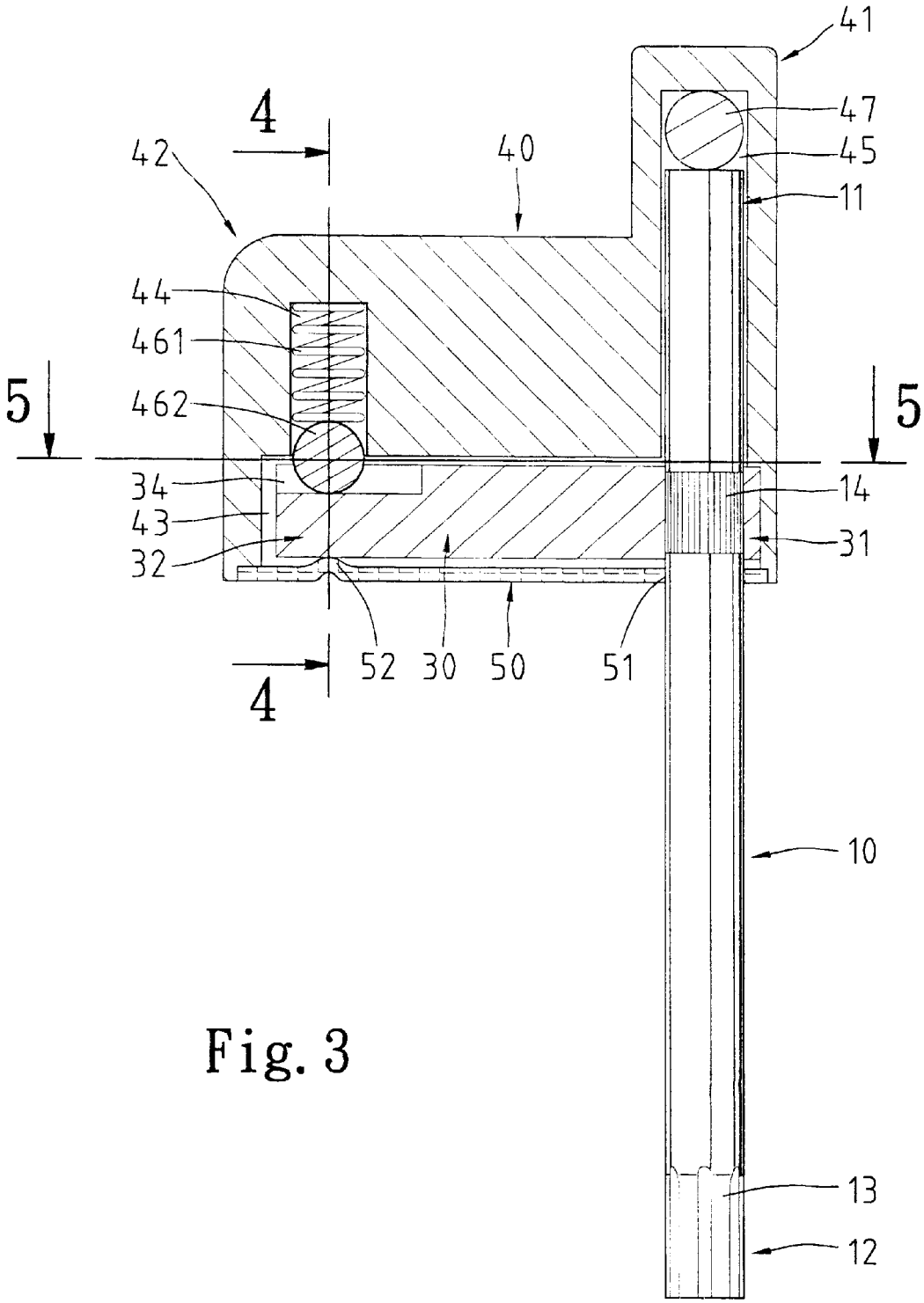
FIG. 3 is a sectional view taken along plane 3—3 in FIG. 1.

The casing 40 comprises a first end 41 and a second end 42. A grip portion 49 is formed on the second end 42 of the casing 40 for manual turning operation. A receiving section 43 is defined in the casing 40 for accommodating the retainer 30 while allowing relative pivotal movement between the casing 40 and the retainer 30. Referring to FIGS. 2 and 3, a positioning hole 45 is defined in the first end 41 of the casing 40. The first end 11 of the rod 10 is received in the positioning hole 45 of the casing 40, and a ball 47 is provided between an end face of the first end 11 of the rod 10 and an end wall defining a portion of the positioning hole 45 of the casing 40 to provide a smooth rotation therebetween. A recessed portion 48 surrounds the receiving section 43 of the casing 40, and a lid 50 is mounted in the recessed portion 48 for closing the receiving section 43. The lid 50 has a hole 51 in an end thereof through which the rod 10 extends. The lid 50 further includes a protrusion 52 on the other end thereof. The second end 32 of the retainer 30 is slidably supported by the protrusion 52. The casing 40 further includes a receptacle 44 extending along a direction parallel to the positioning hole 45. A biasing means (such as an elastic element 461) and an engaging member (such as a ball 462) is mounted in the receptacle 44.

Figure 4:
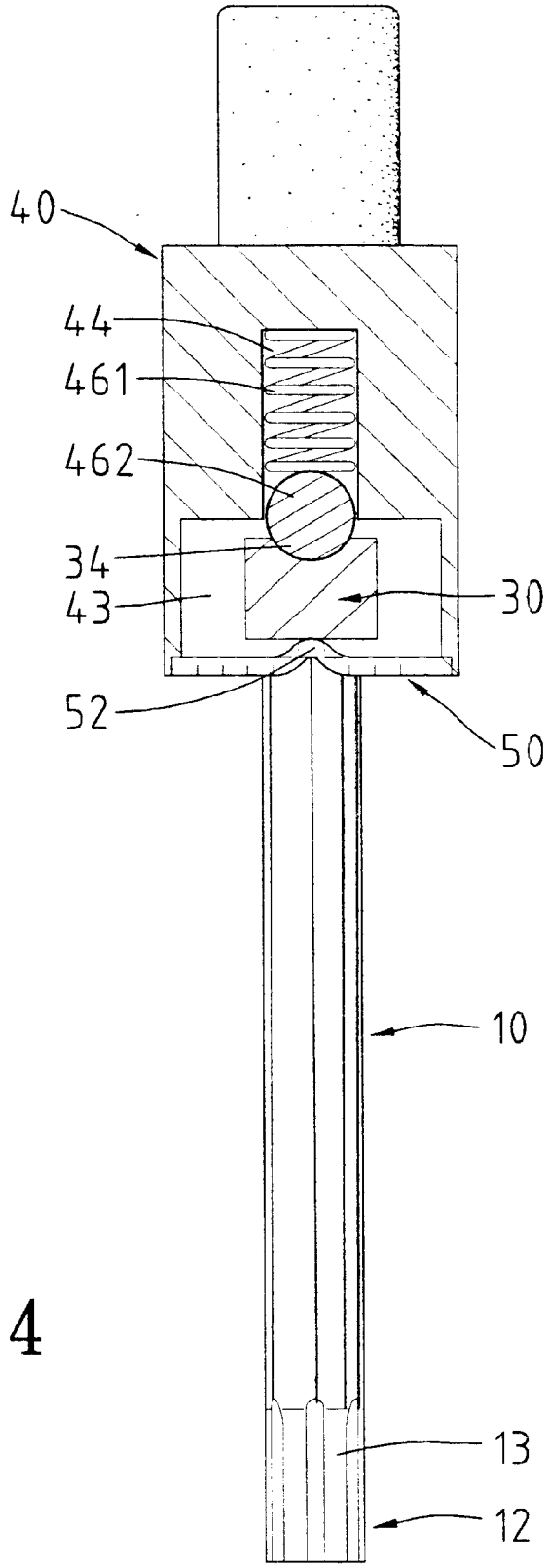
FIG. 4 is a sectional view taken along plane 4—4 in FIG. 3.

Referring to FIGS. 3 and 4, the ball 462 is biased by the elastic element 461 to press against a bottom wall defining the groove 34 of the retainer 30. Namely, a predetermined engaging force exists between the bottom wall defining the groove 34 of the retainer 30 and the ball 462 under the action of the elastic element 461.

Figure 5:
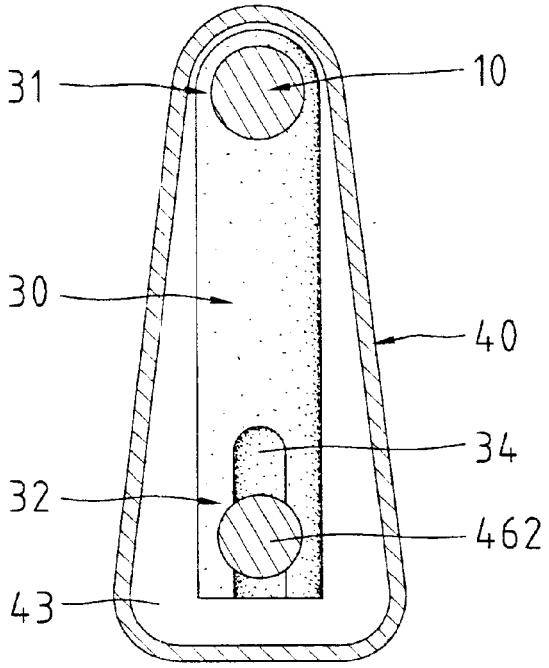
FIG. 5 is a sectional view taken along plane 5—5 in FIG. 3.

When driving a TROX type bolt (not shown) for a cutting tool (not shown), the driving portion 13 of the second end 12 of the rod 10 is engaged with the bolt, and the casing 40 is then turned by means of gripping and turning the grip portion 49. Referring to FIGS. 4 and 5, when the rotational force applied to the wrench is smaller than the predetermined engaging force between the bottom wall defining the groove 34 of the retainer 30 and the ball 462, the retainer 30 and the rod 10 turn together with the casing 40 to thereby drive the bolt.

Figure 7:
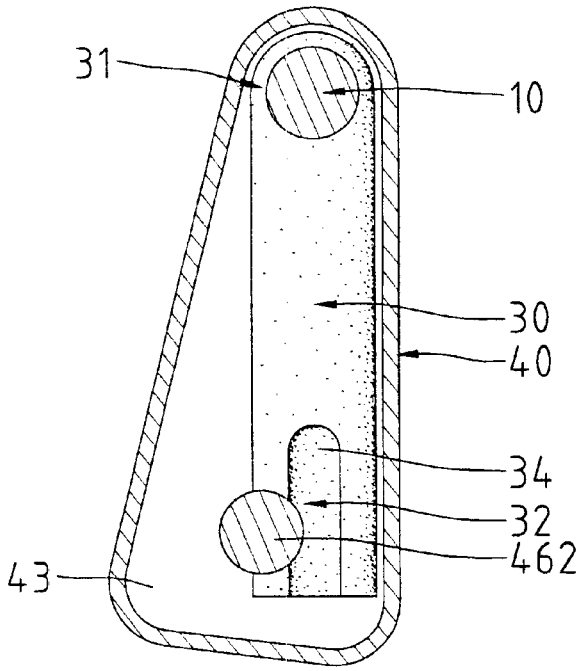
FIG. 7 is a view similar to FIG. 5, illustrating operation of the wrench in accordance with the present invention.
Figure 6:
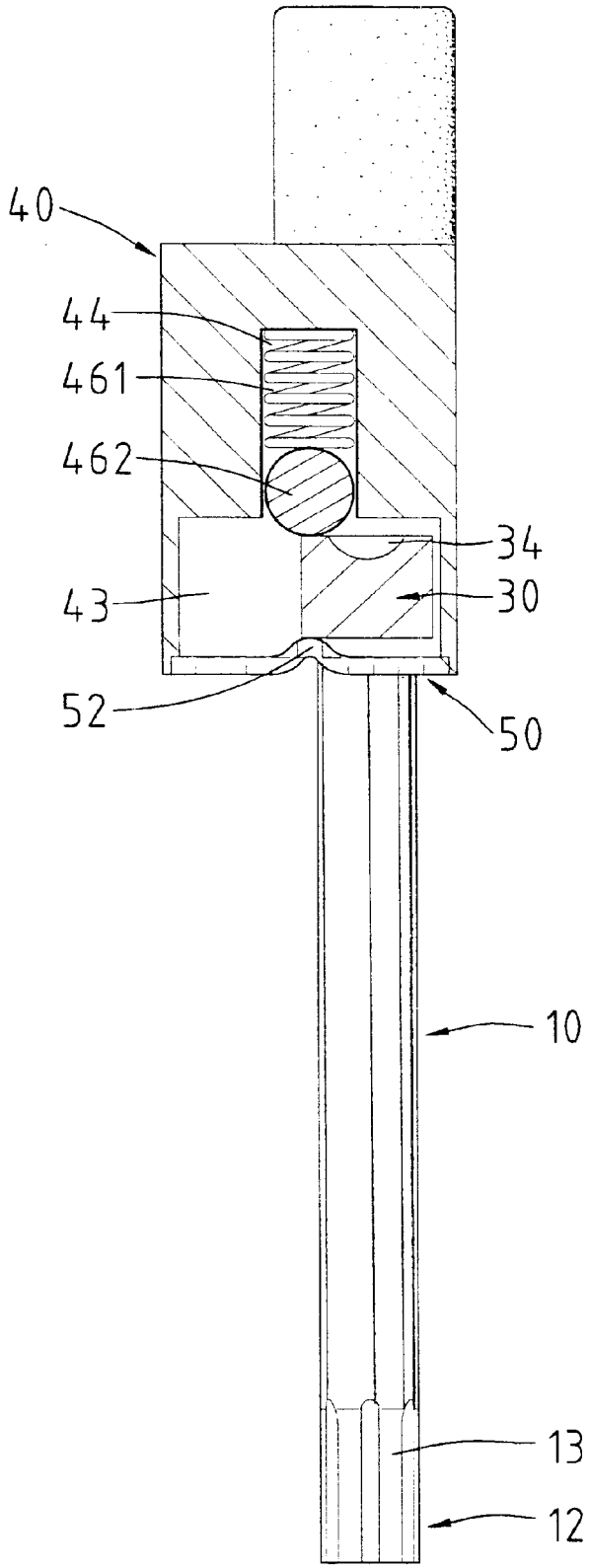
FIG. 6 is a view similar to FIG. 4, illustrating operation of the wrench in accordance with the present invention.

When the rotational force applied to the wrench is greater than the predetermined engaging force between the bottom wall defining the groove 34 of the retainer 30 and the ball 462, as illustrated in FIGS. 6 and 7, the elastic element 461 is compressed to absorb the excessive amount of rotational force. Since the elastic element 461 is compressed, a sliding action is generated between the ball 462 and the bottom wall defining the groove 34 of the retainer 30. The ball 462 is thus disengaged from the groove 34 of the retainer 30, and the casing 40 slides relative to the retainer 30; namely, the retainer 30 and the rod 10 are not turned. As a result, the bolt is not turned. The casing 40 returns to its original position shown in FIGS. 4 and 5 under the action of the elastic element 461 when the rotational force is released. The protrusion 52 of the lid 50 allows smooth relative pivotal movement between the casing 40 and the retainer 30.

It is noted that the engaging force, which largely depends on the elastic coefficient of the elastic element 461, determines a maximum operational torque for turning the rod 10. Namely, when the torque applied to the casing 40 is smaller than the maximum operational torque, the retainer 30 and the rod 10 are turned, and when the torque applied to the casing 40 is greater than the maximum operational torque, the retainer 30 and the rod 10 are not turned. During tightening of the bolt, the bolt before being tightened is turned by means of applying a torque smaller than the maximum operational torque. When the bolt is tightened, the torque required to turn the casing 40 would be greater than the maximum operational torque such that the casing 40 slides. Thus, the user will notice the sliding motion of the casing 40 and be aware of tightening of the bolt. As a result, damage to the bolt and the cutting tool resulting from over-tightening is avoided. The maximum operational torque can be altered by means of selecting elastic elements of different elastic coefficients. The maximum operational torque is a constant and thus allows accurate operation. This advantageous design can be used in a limited space, and the manufacturing cost of the wrench is largely reduced.

Figure 8:
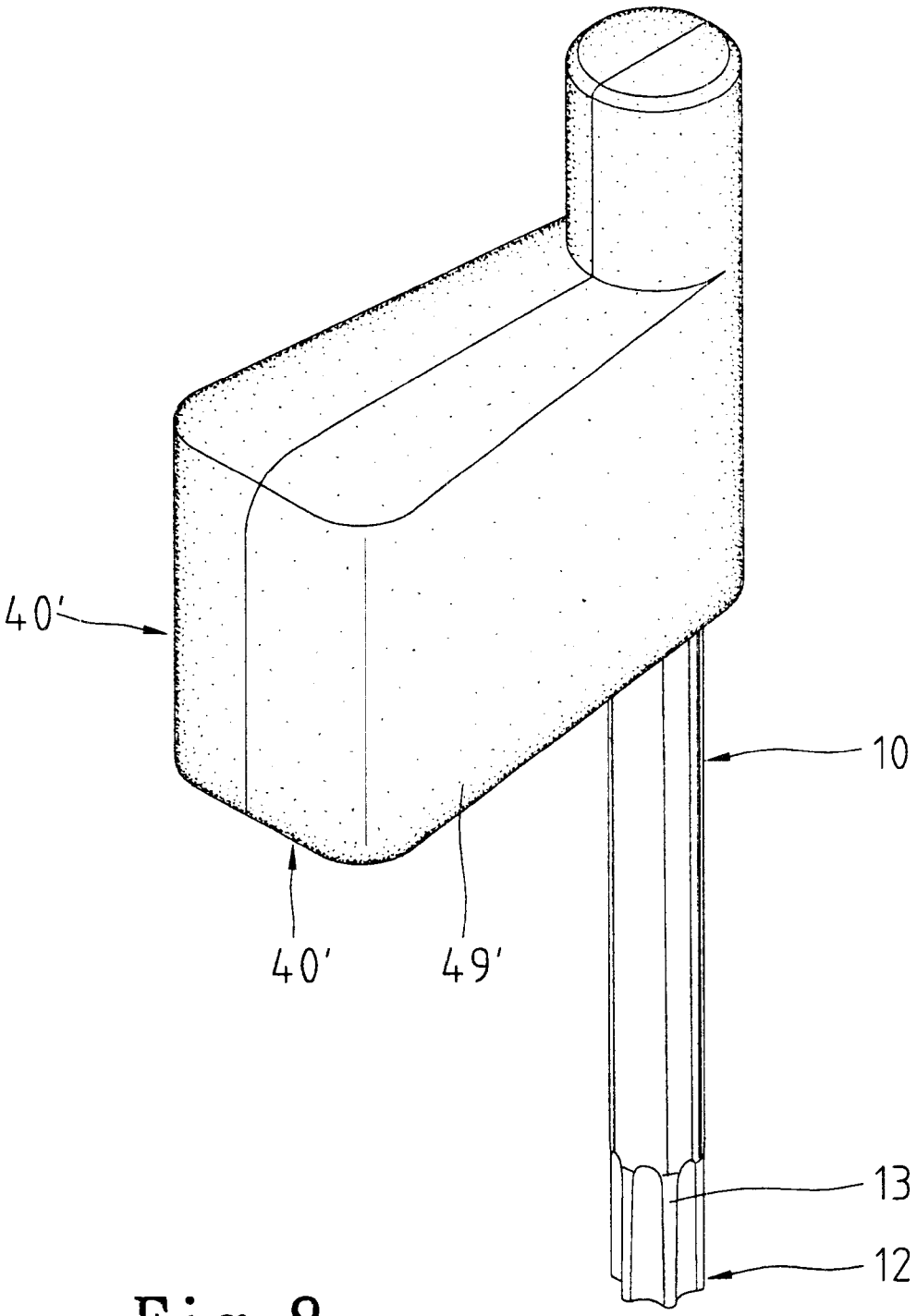
FIG. 8 is a perspective view of a modified embodiment of the wrench in accordance with the present invention.
Figure 9:
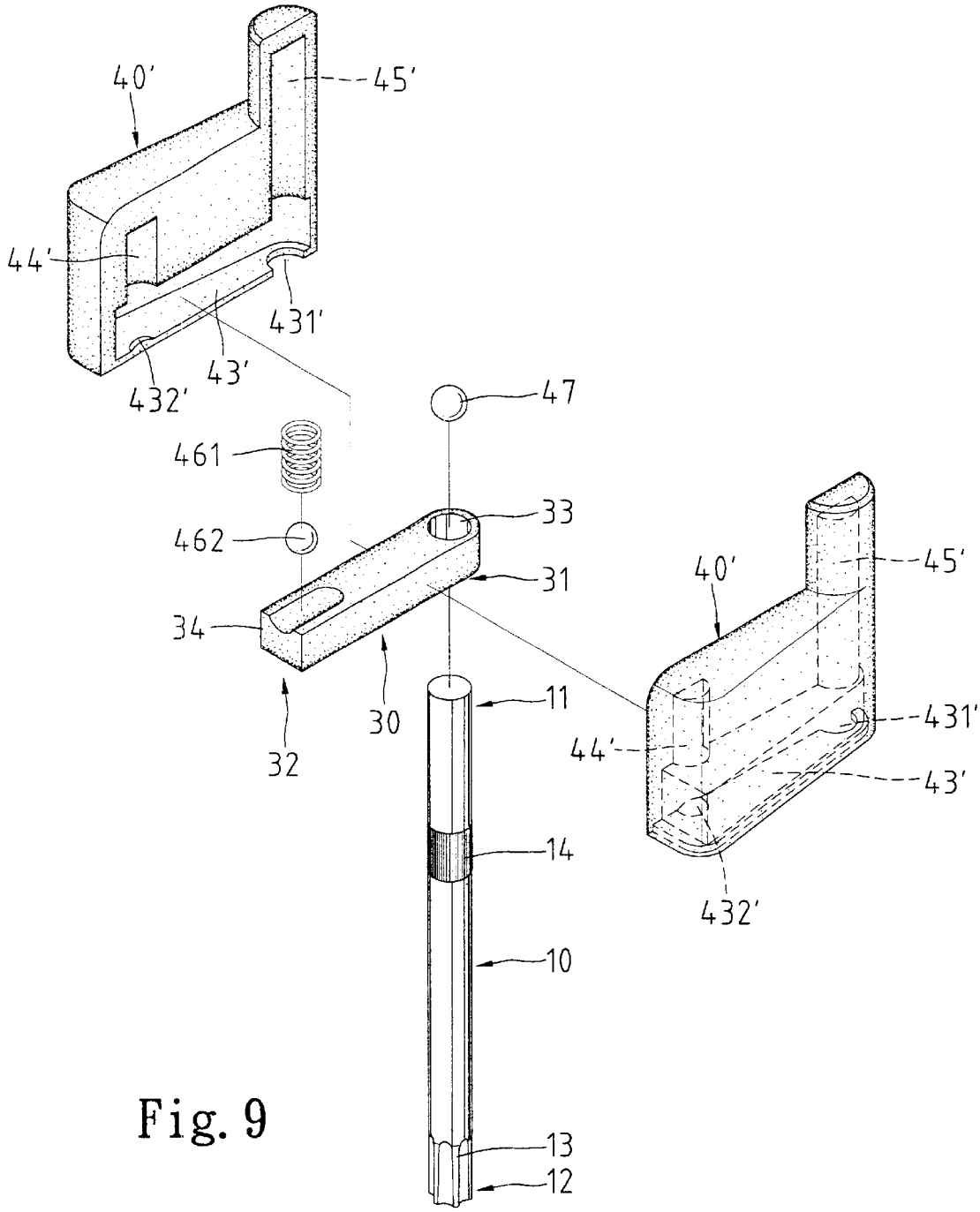
FIG. 9 is an exploded perspective view of the modified embodiment of FIG. 8.

FIGS. 8 and 9 illustrate a modified embodiment of the invention, wherein the casing is comprised of two half casings 40' together defining a positioning hole 45' for receiving the first end 11 of the rod 10, a receiving section 43' for receiving the retainer 30, and a receptacle 44' for receiving the elastic element 461 and the ball 462. A grip portion 49' is formed on the end of the half casings 40' for manual turning operation. In addition, the lid in this embodiment is integrally formed as a bottom wall of each of the half casings 40'. Namely, the bottom wall of each half casing 40' includes a semi-circular hole 431' through which the rod 10 extends and a protrusion 432' for slidably supporting the second end 32 of the retainer 30. Operation of this embodiment is identical to that of the first embodiment.

Figure 10:
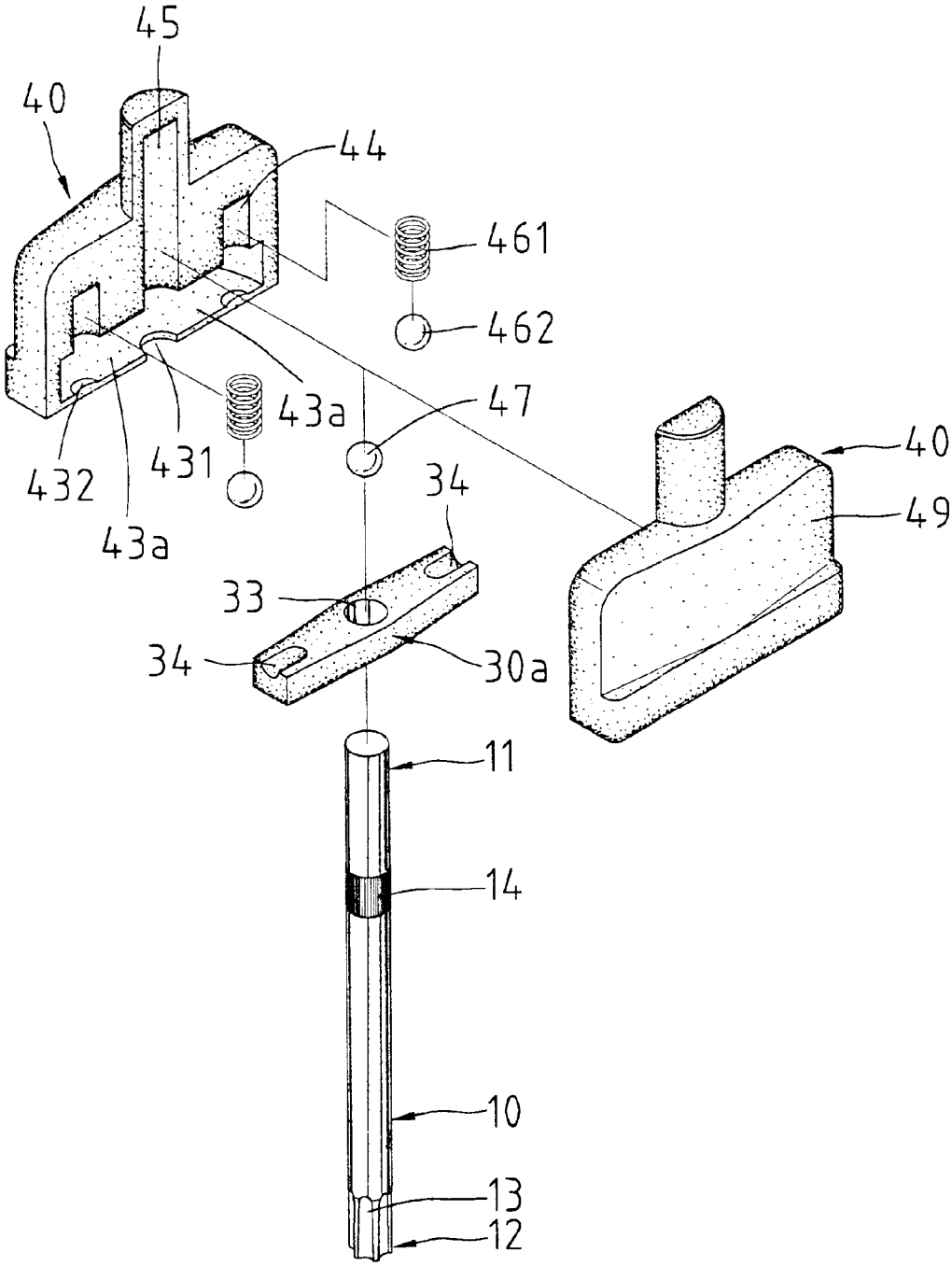
FIG. 10 is an exploded perspective view illustrating another modified embodiment of the wrench in accordance with the present invention.
Figure 11:
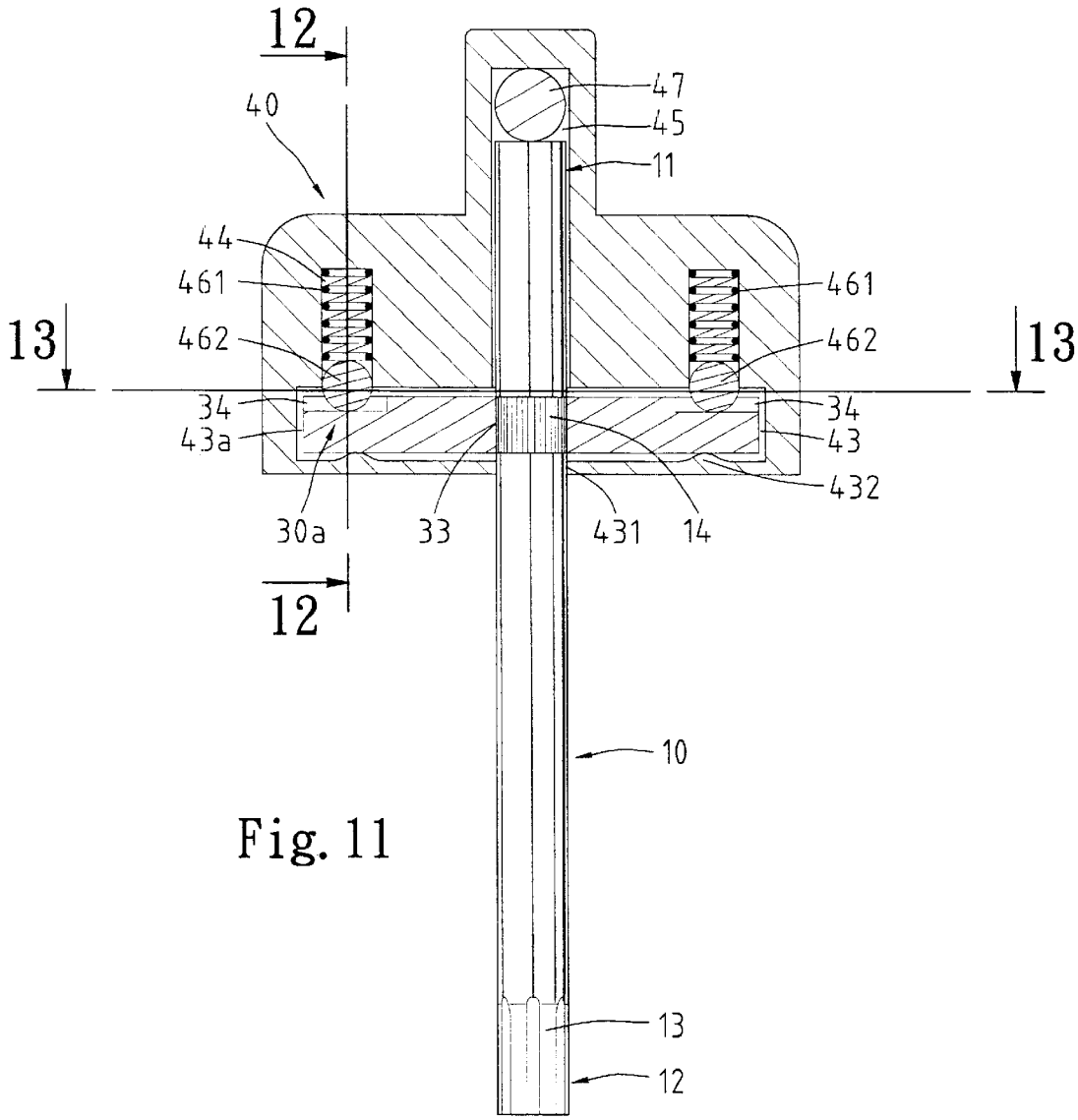
FIG. 11 is a sectional view of the wrench in FIG. 10.

FIGS. 10 and 11 illustrate another modified embodiment of the wrench in accordance with the present invention. In this embodiment, the wrench includes a rod 10, a retainer **30*a*, and a casing 40. The rod 10 comprises a first end 11 and a second end 12 with a driving portion 13 for engaging with a fastener. In this embodiment, the driving portion 13 is shaped as a TROX type wrench. The rod 10 further has an embossed section 14 that is preferably adjacent to the first end 11** thereof.

The retainer **30*a* includes a hole 33 in a center thereof for securely engaging with the embossed section 14 of the rod 10. Thus, the retainer 30*a* and the rod 10 rotate jointly. The retainer 30*a* further includes a groove 34** in each of two ends thereof.

The casing 40 comprises a grip portion 49 for manual turning operation. A compartment **43*a* is defined in the casing 40 for accommodating the retainer 30*a* while allowing relative pivotal movement between the casing 40 and the retainer 30*a*. Referring to FIGS. 10 and 11, a positioning hole 45 is defined in a center of casing 40. The first end 11 of the rod 10 is received in the positioning hole 45 of the casing 40, and a ball 47 is provided between an end face of the first end 11 of the rod 10 and an end wall defining a portion of the positioning hole 45 of the casing 40 to provide a smooth rotation therebetween. A bottom wall 430 defining the compartment 43*a* includes a hole 431 aligned with the positioning hole 45, thereby rotatably holding the rod 10. The bottom wall 430 further includes two protrusions 432 respectively on two ends thereof. The two ends of the retainer 30*a* are slidably supported by the protrusions 432. The casing 40 further includes two receptacles 44 extending along a direction parallel to the positioning hole 45. A biasing means (such as an elastic element 461) and an engaging member (such as a ball 462) is mounted in each receptacle 44. In this embodiment, the casing 40** is comprised of two casing halves.

Figure 12:
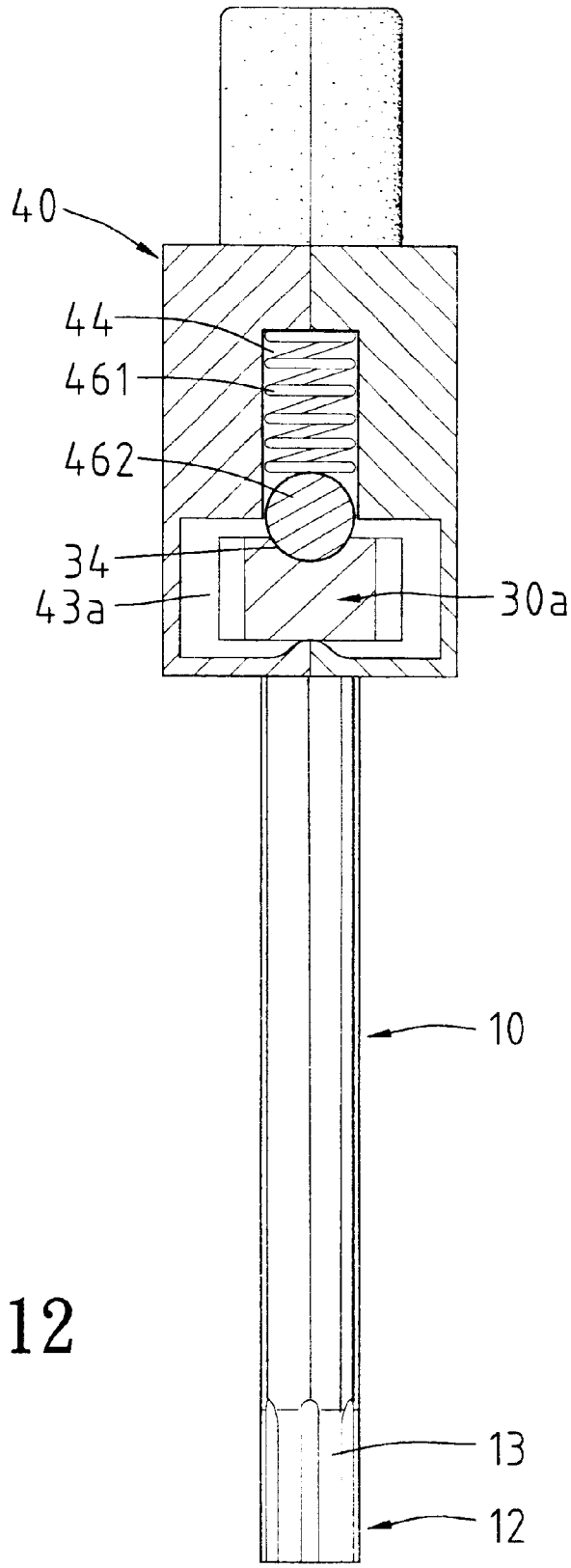
FIG. 12 is a sectional view taken along plane 12—12 in FIG. 11.

Referring to FIGS. 11 and 12, each ball 462 is biased by the associated elastic element 461 to press against a bottom wall defining the associated groove 34 of the retainer **30*a*. Namely, a predetermined engaging force exists between each bottom wall defining the associated groove 34 of the retainer 30*a* and the associated ball 462 under the action of the associated elastic element 461**.

Figure 13:
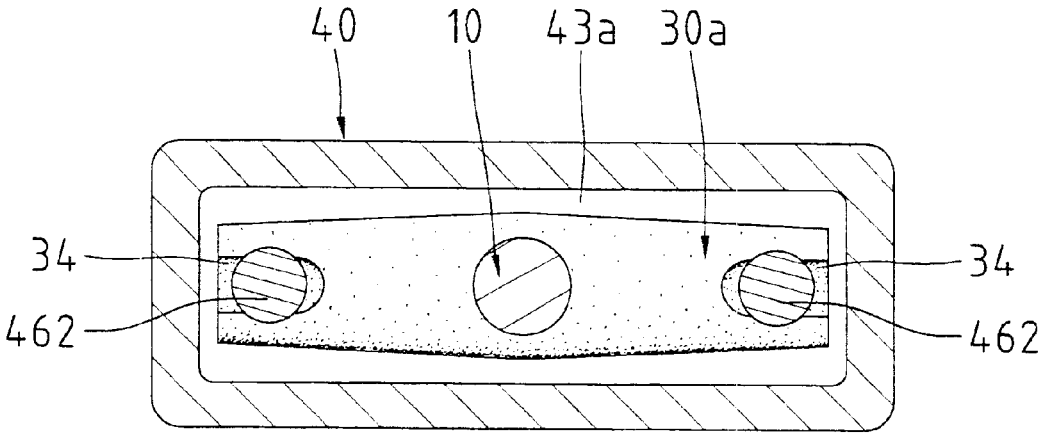
FIG. 13 is a sectional view taken along plane 13—13 in FIG. 11.

When driving a TROX type bolt (not shown) for a cutting tool (not shown), the driving portion 13 of the second end 12 of the rod 10 is engaged with the bolt, and the casing 40 is then turned by means of gripping and turning the grip portion 49. Referring to FIGS. 12 and 13, when the rotational force applied to the wrench is smaller than the predetermined engaging force between each bottom wall defining the groove 34 of the retainer 30*a* and the associated ball 462, the retainer 30*a* and the rod 10 turn together with the casing 40 to thereby drive the bolt.

Figure 15:
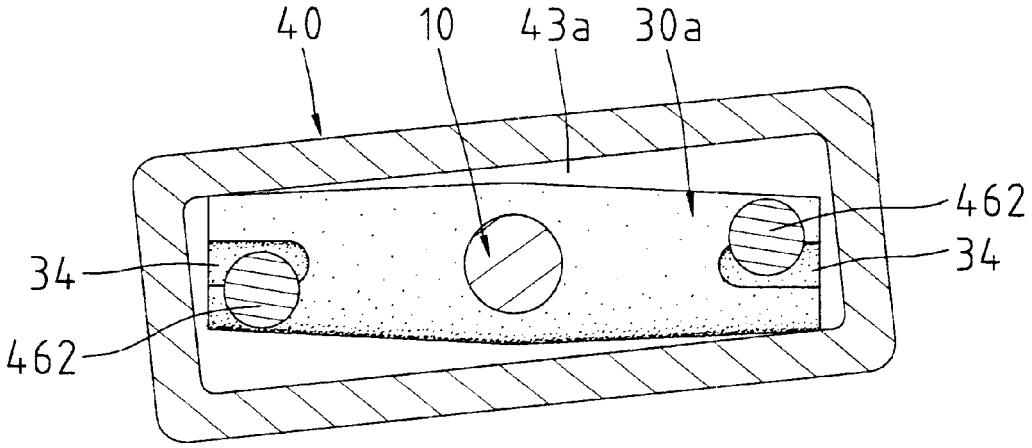
FIG. 15 is a view similar to FIG. 13, illustrating operation of the wrench in accordance with the present invention.
Figure 14:
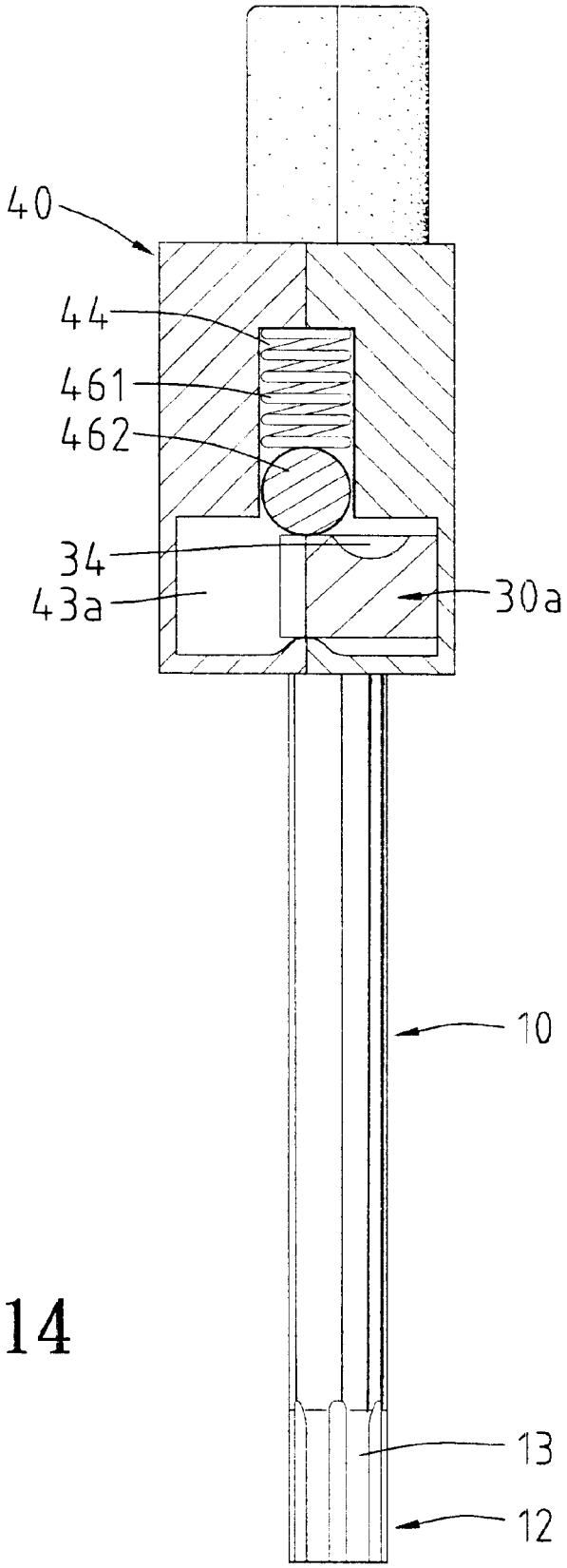
FIG. 14 is a view similar to FIG. 12, illustrating operation of the wrench in accordance with the present invention.
Figure 16A:
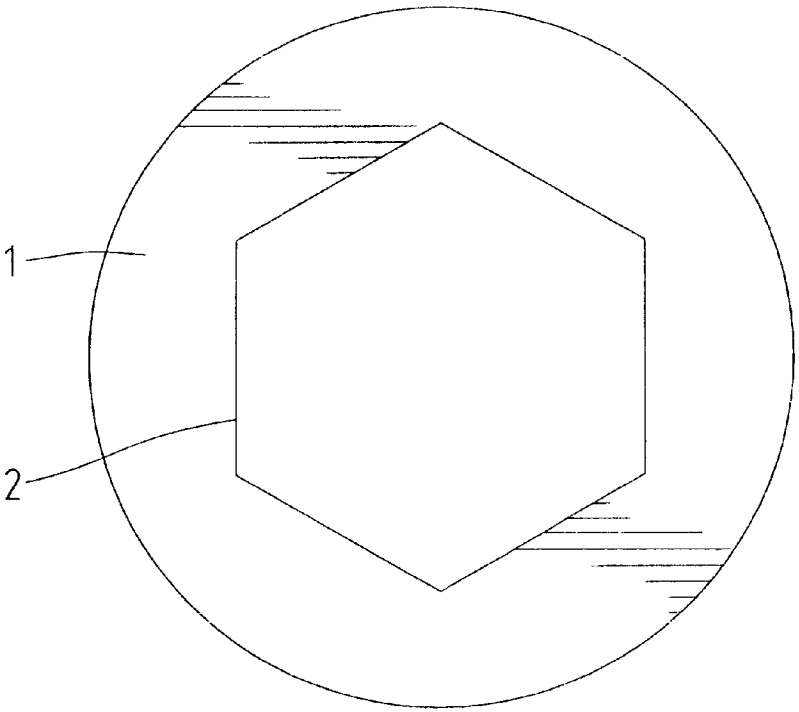
Fig. 16A PRIOR ART
FIG. 16A is an end view of a conventional hexagonal wrench.
Figure 16B:
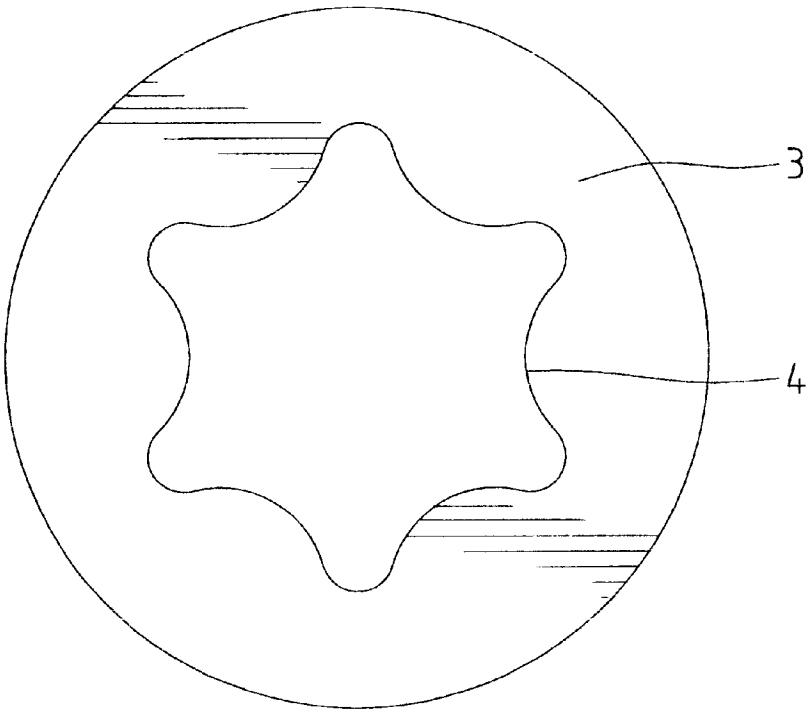
Fig. 16B PRIOR ART
FIG. 16B is an end view of a conventional TROX wrench.
Figure 17:
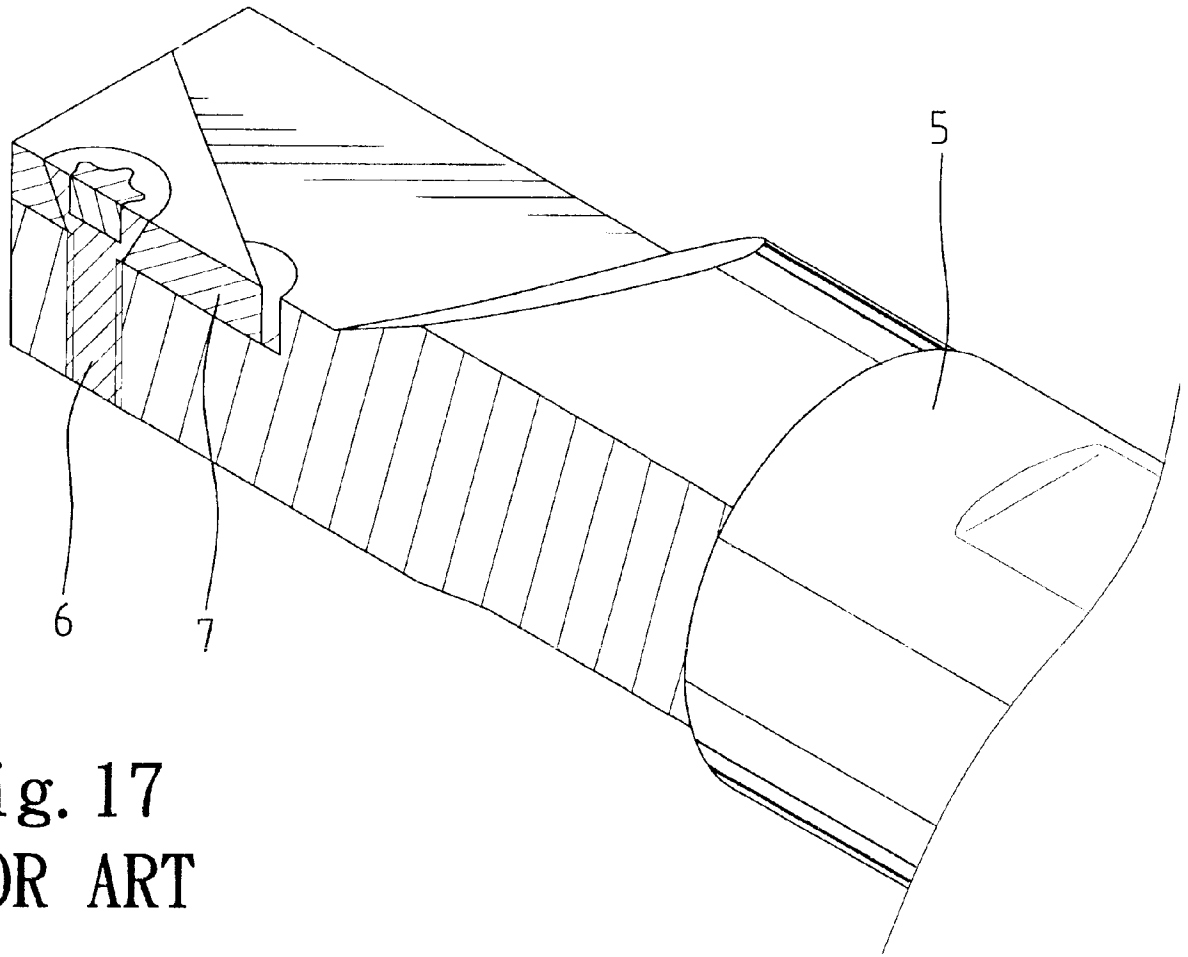
Fig. 17 PRIOR ART
FIG. 17 is a perspective view, partly cutaway, of a cutting tool.

When the rotational force applied to the wrench is greater than the predetermined engaging force between each bottom wall defining the associated groove 34 of the retainer 30*a* and the ball 462, as illustrated in FIGS. 14 and 15, each elastic element 461 is compressed to absorb the excessive amount of rotational force. Since each elastic element 461 is compressed, a sliding action is generated between each ball 462 and the bottom wall defining the associated groove 34 of the retainer 30*a*. Each ball 462 is thus disengaged from the associated groove 34 of the retainer 30*a*, and the casing 40 slides relative to the retainer 30*a*; namely, the retainer 30*a* and the rod 10 are not turned. As a result, the bolt is not turned. The casing 40 returns to its original position shown in FIGS. 12 and 13 under the action of the elastic elements 461 when the rotational force is released. The protrusions 432 of the casing 40 allow smooth relative pivotal movement between the casing 40 and the retainer 30*a*.

It is noted that the engaging force, which largely depends on the elastic coefficients of the elastic elements 461, determines a maximum operational torque for turning the rod 10. Namely, when the torque applied to the casing 40 is smaller than the maximum operational torque, the retainer 30*a* and the rod 10 are turned, and when the torque applied to the casing 40 is greater than the maximum operational torque, the retainer 30*a* and the rod 10 are not turned. During tightening of the bolt, the bolt before being tightened is turned by means of applying a torque smaller than the maximum operational torque. When the bolt is tightened, the torque required to turn the casing 40 would be greater than the maximum operational torque such that the casing 40 slides. Thus, the user will notice the sliding motion of the casing 40 and be aware of tightening of the bolt. Damage to the bolt and the cutting tool resulting from over-tightening is avoided. The maximum operational torque can be altered by means of selecting elastic elements of different elastic coefficients. The maximum operational torque is a constant and thus allows accurate operation. This advantageous design can be used in a limited space, and the manufacturing cost of the wrench is largely reduced.

Although the invention has been explained in relation to its preferred embodiment, it is to be understood that many other possible modifications and variations can be made without departing from the scope of the invention as hereinafter claimed.

What is claimed is:

1. A wrench comprising:

a rod comprising a driving portion on an end thereof for engaging with a fastener;

a retainer having a first end securely mounted to the rod to turn therewith and a second end;

a casing fir accommodating the retainer and allowing relative pivotal movement between the casing and the retainer;

an engaging member mounted in the casing; and means for biasing the engaging member to engage with the second end of the retainer, thereby exerting an engaging force between the second end of the retainer and the engaging member;

wherein when a rotational force applied to the casing is smaller than the engaging force, the retainer and the rod are turned to thereby turn the fastener; and wherein when a rotational force applied to the casing is greater than the engaging force, the casing slides while the retainer and the rod are not turned.

2. The wrench as claimed in claim 1, wherein the second end of the retainer includes a groove, and wherein the engaging member is a ball that is biased by the biasing means to press against a bottom wall defining the groove.

3. The wrench as claimed in claim 1, wherein the first end of the retainer has a hole through which the rod extends.

4. The wrench as claimed in claim 3, wherein the rod comprises an embossed section that is securely engaged in the hole of the retainer.

5. The wrench as claimed in claim 1, wherein the casing includes a receiving section for accommodating the retainer.

6. The wrench as claimed in claim 5, further comprising a lid for closing the receiving section.

7. The wrench as claimed in claim 6, wherein the lid comprises a hole through which the rod extends.

8. The wrench as claimed in claim 6, wherein the lid includes a protrusion supporting the retainer, thereby allowing smooth rotation of the casing relative to the retainer.

9. The wrench as claimed in claim 8, wherein the casing is comprised of two casing halves.

10. The wrench as claimed in claim 9, wherein the lid is integrally formed with the casing halves.

11. The wrench as claimed in claim 5, wherein the casing comprises a recessed portion surrounding the receiving section, further comprising a lid mounted in the recessed portion for closing the receiving section.

12. The wrench as claimed in claim 11, wherein the lid comprises a hole through which the rod extends.

13. The wrench as claimed in claim 11, wherein the lid includes a protrusion supporting the retainer, thereby allowing smooth rotation of the casing relative to the retainer.

14. The wrench as claimed in claim 11, wherein the casing is comprised of two casing halves.

15. The wrench as claimed in claim 14, wherein the lid is integrally formed with the casing halves.

16. The wrench as claimed in claim 1, wherein the casing comprises a positioning hole for receiving another end of the rod.

17. The wrench as claimed in claim 16, further comprising a ball mounted between an end face of said another end of the rod and an end wall defining a portion of the positioning hole.

18. The wrench as claimed in claim 16, wherein the casing comprises a receptacle extending along a direction parallel to the positioning hole of the casing, the engaging member and the biasing means being received in the receptacle.

19. The wrench as claimed in claim 1, wherein the casing comprises a grip portion.

20. The wrench as claimed in claim 1, wherein the casing is comprised of two casing halves.

21. The wrench as claimed in claim 1, wherein each of the ends of the retainer includes a groove, and wherein each of the engaging members is a ball that is biased by the biasing means to press against a bottom wall defining an associated one of the grooves.

22. A wrench comprising:

a rod comprising a driving portion on an end thereof for engaging with a fastener;

a retainer having a central portion securely mounted to the rod to turn therewith and two ends;

a casing for accommodating the retainer and allowing relative pivotal movement between the casing and the retainer;

two engaging members mounted in the casing; and means for biasing the engaging members to respectively engage with the ends of the retainer, thereby exerting an engaging force between each of the ends of the retainer and an associated one of the engaging members;

wherein when a rotational force applied to the casing is smaller than the engaging force, the retainer and the rod are turned to thereby turn the fastener; and wherein when a rotational force applied to the casing is greater than the engaging force, the casing slides while the retainer and the rod are not turned.

23. The wrench as claimed in claim 21, wherein the central portion of the retainer has a hole through which the rod extends.

24. The wrench as claimed in claim 23, wherein the rod comprises an embossed section that is securely engaged in the hole of the retainer.

25. The wrench as claimed in claim 21, wherein the easing includes a compartment for accommodating the retainer.

26. The wrench as claimed in claim 25, wherein a bottom wall defining the compartment includes a hole through which the rod extends.

27. The wrench as claimed in claim 26, wherein the bottom wall defining the compartment includes two protrusions for respectively supporting the ends of the retainer, thereby allowing smooth rotation of the casing relative to the retainer.

28. The wrench as claimed in claim 21, wherein the casing comprises a positioning hole for receiving another end of the rod.

29. The wrench as claimed in claim 28, further comprising a ball mounted between an end face of said another end of the rod and an end wall defining a portion of the positioning hole.

30. The wrench as claimed in claim 28, wherein the casing comprises two receptacles extending along a direction parallel to the positioning hole of the casing, the engaging members being respectively received in the receptacles, the biasing means including two elastic elements respectively received in the receptacles for respectively biasing the engaging members.

31. The wrench as claimed in claim 22, wherein the casing comprises a grip portion.

32. The wrench as claimed in claim 22, wherein the casing is comprised of two casing halves.

* * * * *